US010227122B2

(12) United States Patent
Walpurgis

(10) Patent No.: US 10,227,122 B2
(45) Date of Patent: Mar. 12, 2019

(54) SWIMMING AND DIVING AID

(71) Applicant: Cayago GmbH, Kitzbühel (AT)

(72) Inventor: Hans-Peter Walpurgis, Kitzbühel (AT)

(73) Assignee: Cayago GmbH (AT)

( * ) Notice: Subject to any disclaimer, the term of this patent is extended or adjusted under 35 U.S.C. 154(b) by 0 days.

(21) Appl. No.: 15/541,227

(22) PCT Filed: Jan. 12, 2016

(86) PCT No.: PCT/EP2016/050432
§ 371 (c)(1),
(2) Date: Dec. 18, 2017

(87) PCT Pub. No.: WO2016/113237
PCT Pub. Date: Jul. 21, 2016

(65) Prior Publication Data

US 2018/0134358 A1 May 17, 2018

(30) Foreign Application Priority Data

Jan. 16, 2015 (DE) ..... 10 2015 000 259

(51) Int. Cl.
*B63H 23/24* (2006.01)
*B63H 11/08* (2006.01)
(Continued)

(52) U.S. Cl.
CPC ..... *B63H 11/08* (2013.01); *B63H 21/17* (2013.01); *B63H 23/00* (2013.01); *B63H 23/24* (2013.01); *B63H 2023/005* (2013.01)

(58) Field of Classification Search
CPC ..... B63H 11/08; B63H 21/17; B63H 23/24; B63H 23/00
See application file for complete search history.

(56) References Cited

U.S. PATENT DOCUMENTS 3,466,798 A * 9/1969 Guglielmi ..... A63H 23/10 114/300
4,864,959 A * 9/1989 Takamizawa ..... A63B 35/12 114/315
(Continued)

FOREIGN PATENT DOCUMENTS

CN 101551740 A 10/2009
DE 20301041 U1 9/2003
(Continued)

OTHER PUBLICATIONS

International Preliminary Report on Patentability for International application No. PCT/EP2016/050432, dated Jul. 18, 2017, 7 pages (not prior art).
(Continued)

*Primary Examiner* — Lars A Olson
*Assistant Examiner* — Jovon E Hayes
(74) *Attorney, Agent, or Firm* — Lucian Wayne Beavers; Patterson Intellectual Property Law, PC

(57) ABSTRACT

The invention relates to a swimming and diving aid with a vehicle hull on which a user lies or stands, with a flow channel which is arranged in the vehicle hull and which accommodates a propeller driven by an electric motor with radially outwardly directed propeller blades mounted on a base part of the propeller, wherein the electric motor has a rigidly arranged motor stator and a rotating rotor, which is spatially assigned to the motor stator. Provision is made that the rotor of the electric motor is coupled directly or indirectly to at least one outer end of at least one propeller blade, and that the motor stator is arranged circumferentially around the rotor at least in sections. The motor arrangement permits a dynamic drive of the swimming and diving aid.

17 Claims, 6 Drawing Sheets

Figure 1:
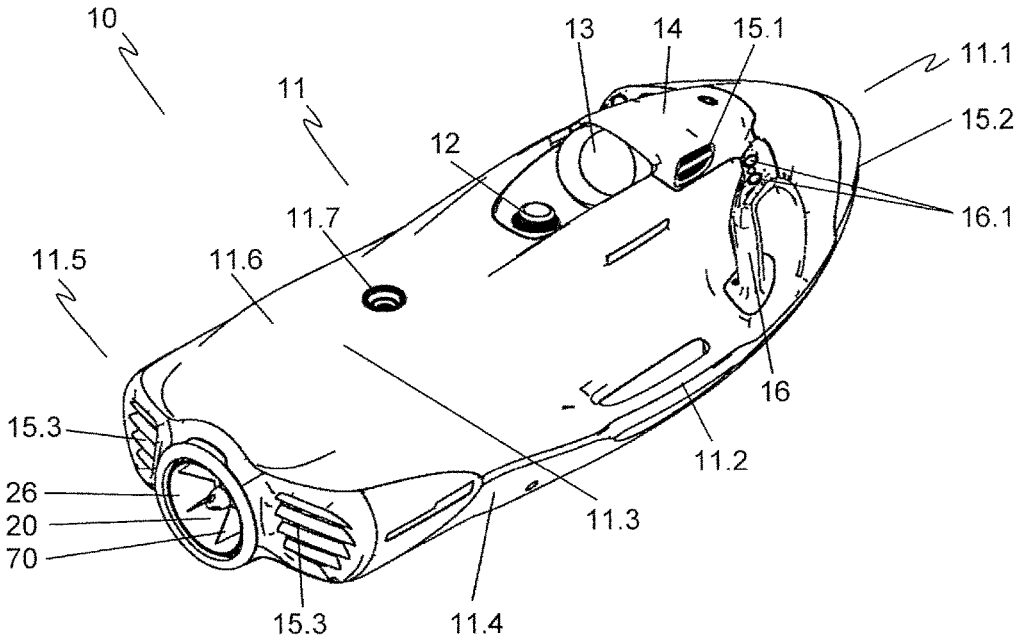

(51) Int. Cl.
*B63H 21/17* (2006.01)
*B63H 23/00* (2006.01)

(56) References Cited

U.S. PATENT DOCUMENTS 4,962,717 A * 10/1990 Tsumiyama ..... B63H 21/213 114/144 R
4,996,938 A * 3/1991 Cameron ..... A63B 35/12 114/315
D323,808 S * 2/1992 DeSantis ..... D12/300
5,158,034 A * 10/1992 Hsu ..... A63B 35/12 114/315
5,379,714 A * 1/1995 Lewis ..... B63C 11/46 114/315
5,388,543 A * 2/1995 Ditchfield ..... A63B 35/12 114/242
5,396,860 A * 3/1995 Cheng ..... B63C 11/46 114/315
5,484,266 A 1/1996 Murga
6,461,204 B1 * 10/2002 Takura ..... A63B 35/12 114/315
7,329,160 B2 * 2/2008 Grimmeisen ..... B63B 35/731 114/315
9,180,343 B2 * 11/2015 Yeo ..... B63C 11/46
9,540,090 B2 * 1/2017 Fenu ..... B63H 25/02
D789,867 S * 6/2017 Walpurgis ..... D12/308
9,694,888 B2 * 7/2017 Walpurgis ..... B63C 11/46
9,774,019 B2 * 9/2017 Walpurgis ..... H01M 2/1077
2001/0025594 A1 * 10/2001 Daniels ..... B63B 35/73 114/315
2005/0181686 A1 * 8/2005 Grimmeisen ..... B63B 35/731 440/6
2006/0043738 A1 * 3/2006 Roos ..... F03B 3/04 290/54
2015/0353175 A1 * 12/2015 Walpurgis ..... A63B 35/12 114/315
2015/0367922 A1 * 12/2015 Walpurgis ..... B63C 11/46 440/68
2018/0134358 A1 * 5/2018 Walpurgis ..... B63H 23/24

FOREIGN PATENT DOCUMENTS

DE 102013100543 A1 7/2014
DE 102013100544 A1 7/2014
JP 626892 A 1/1987
JP 2002362488 A 12/2002

OTHER PUBLICATIONS

International Search Report for International application No. PCT/EP2016/050432, dated May 18, 2016, 3 pages (not prior art).
Chinese Office Action for corresponding application No. 2018083001721870 dated Sep. 4, 2018, 7 pages (not prior art).

* cited by examiner

SWIMMING AND DIVING AID

The invention relates to a swimming and diving aid with a vehicle hull on which a user lies or stands, with a flow channel which is arranged in the vehicle hull and which accommodates a propeller, driven by an electric motor, with radially outwardly directed propeller blades mounted on a base part of the propeller, wherein the electric motor has a rigidly arranged motor stator and a rotating rotor which is spatially assigned to the motor stator.

This type of swimming and diving aid is known from DE 10 2004 049 615 B4. They have a handle arrangement which a user may grip while he or she lies with part of his/her upper body on the upper side on the vehicle hull of the water vehicle. A flow channel, in which a propeller is accommodated, is arranged within the vehicle hull. The propeller is driven by an electric motor which is supplied with electricity via accumulators. For this purpose the propeller is connected to the electric motor via a drive shaft. The electric motor is held in an accommodation housing, which extends up to the propeller. The drive shaft is guided via a sealing cassette out of the housing to the propeller. The accommodation housing, which is thus designed to be water tight, may be arranged with the electric motor in a chamber in the vehicle hull of the swimming and diving aid which is flooded by water, and thus discharges its waste heat to the water flowing past. It is provided for this purpose that the propeller, the electric motor, and an associated control device are designed as an underwater drive unit and are arranged in the flow channel.

In such an arrangement, the advantages of a compact design and good efficiency achieved by the cooling are opposed by the disadvantage that the electric motor is arranged in the flow channel and thus substantially influences the flow of the water. This applies in particular for powerful electric motors, which provide a high torque for fast acceleration of the swimming and diving aid, and must transfer said torque to the propeller via a drive shaft, which has a comparatively small diameter and thus a short lever arm in the area of force transmission. The flow channel must therefore be dimensioned sufficiently large to compensate for the shadowing caused by the electric motor. The dimensions of the swimming and diving aid are influenced thereby.

Therefore, a water vehicle is proposed in DE 10 2013 100 544 A1 in which a propeller is arranged in a flow channel. A flooding chamber is provided in a vehicle hull of the water vehicle, said chamber being filled with water during floating and diving operation via water through openings. The electric motor and associated accumulators are arranged in the flooding chamber and are thus efficiently cooled without impacting the flow in the flow channel. The energy transfer from the electric motor to the propeller is carried out via a drive shaft guided in a jacket tube which is guided out of the flooding chamber into the flow channel. The electric motor is thus removed from the flow area of the flow channel; however, it is still cooled by the heat conducting contact with the water in the flooding chamber.

It is disadvantageous in this arrangement that the additional weight of the water vehicle caused by the necessarily extended drive shaft seriously impacts, in particular, the transport of the sport device outside of the water. The increased mass inertia of the drive shaft influences the dynamic of the drive, which must be compensated for by a correspondingly more powerful electric motor with the disadvantage of increased energy consumption. A further disadvantage arises due to the interference, which reduces efficiency, in the flow in the flow channel due to the drive shaft guided through it and by the interruption of the otherwise smooth wall of the flow channel in the area where the drive shaft is guided into the flow channel.

It is the object of the invention to provide a swimming and diving aid which has a low deadweight at high dynamic drive.

The problem of the invention is solved in that the rotor of the electric motor is coupled directly or indirectly to at least one outer end of at least one propeller blade and that the motor stator is arranged circumferentially around the rotor at least in sections. The rotor thus moves on a large circular path with a comparably large distance with respect to its axis of rotation. Thus, a high torque is achieved which is transferred to the propeller. Due to the high torque, fast changes to the rotational speed of the propeller may be achieved, which permits a high dynamic drive of the swimming and diving aid.

Correspondingly, it may be provided in a particularly preferred embodiment variant of the invention that the outer ends of at least one part of the propeller blades are connected to a propeller ring and that the rotor is arranged on the propeller ring and/or that the outer ends of at least one part of the propeller blades are connected to an annular rotor housing and that the rotor is arranged in the rotor housing. The driving force is thus transmitted via multiple propeller blades, by which means the mechanical load of the individual propeller blade is significantly reduced. It is thus possible to transmit very high driving forces to the propeller. The centrifugal forces of the rotor are transferred to the propeller ring or to the rotor housing. Tractive forces that affect diametrically opposite areas of the propeller ring or the rotor housing cancel each other out so that the propeller blades are not subjected to tensile load. This increases the life expectancy of the propeller blades. The propeller ring may constitute the inner base of the rotor housing. When a rotor housing is used, the rotor is protected from water.

A simple and inexpensive production may be achieved in that the propeller ring and/or the rotor housing is moulded as one piece on the propeller. The propeller may thus be manufactured together with the propeller ring or the rotor housing in one work process.

A simple and safe design of the electric motor may be achieved in that the rotor has a plurality of permanent magnets arranged in the rotational direction of the rotor, and/or that the motor stator has a plurality of electromagnets arranged circumferential to the circular path on which the rotor moves. Due to the design of the rotor with permanent magnets, no electricity need be transmitted to the rotor. Thus, a waterproof electrical supply to rotating components is eliminated. A high number of pole pairs is achieved by using a plurality of permanent magnets and electromagnets. Thus, an electric motor with a high torque is obtained.

It may be advantageously provided that a flow stator with stator blades is arranged downstream of the propeller in the flow direction of the water, that the flow stator is attached directly or indirectly to the wall of the flow channel via the stator blades and/or that a stator housing for accommodating the motor stator is connected directly or indirectly with the outer ends of at least one part of the stator blades. The stator blades are aligned in such a way that a conversion of the rotational movement of the water into a linear movement occurs. By this means, the energy stored in the rotation of the water may be obtained for driving the swimming and diving aid. By mounting the flow stator on the flow channel, it is stationarily positioned in the flow channel. It thus does not change its position even at high flow speeds of the water in the flow channel. The stator is preferably arranged circumferential to a circular path on which the rotor moves. The stator is thereby to be stationarily arranged. Both requirements may be easily satisfied by a stator housing connected to the flow stator.

A simple and inexpensive production may be achieved in that the stator housing of the electric motor is moulded as one piece on the flow stator. The flow stator and the stator housing of the electric motor may thus be produced in one work process.

To achieve a desired drive of the swimming and diving aid, a corresponding volume of water must be accelerated to a sufficient speed. A sufficiently large flow cross section is necessary for this. To be able to achieve a sufficiently large flow cross section, it may be provided that the rotor and/or the motor stator are arranged in a lateral recess of the flow channel. The electric motor is thus arranged outside of the main flow of the water guided in the flow channel. The cross section of the flow channel may thus be reduced in contrast to a design in which the electric motor is arranged within the flow channel. As the flow channel occupies a substantial proportion of the vehicle hull, the entire swimming and diving aid may thus be designed more compactly without diminished driving power.

A simple and robust mounting of the propeller may be achieved by axially fixing the propeller on a rotatably mounted shaft arranged within the flow channel.

Corresponding to a preferred embodiment of the invention, it may be provided that the shaft is designed as a hollow shaft and/or that the shaft is manufactured from a carbon fibre reinforced plastic material. By implementing the shaft as a hollow shaft, a weight reduction may be achieved without substantial losses in stability and rigidity of the shaft. Carbon fibre reinforced plastic materials (CFRP) have a significantly lower density with a simultaneously very high rigidity with respect to shafts made from metal. Therefore, a lighter shaft made from CFRP may be used for rotatable mounting of the propeller and for transferring a thrusting force from the propeller to the vehicle hull of the swimming and diving aid. The swimming and diving aid may thus be carried more easily outside of the water. The lower inertia of the motor shaft caused by the lower mass leads to an increased dynamic of the swimming and diving aid at the same power provided by the electric motor, which represents an essential advantage for the use of the swimming and diving aid as a water sport device. This applies in particular since the installable output of the electric motor used and the storage capacity of the associated energy store is strongly limited in a carriable water sport device.

It may be preferably provided that a centring device with a base and centring bars applied thereon is arranged upstream of the propeller in the flow direction of the water flowing in the flow channel, and that the centring device is directly or indirectly attached to the wall of the flow channel via the centring bars. The propeller may be rotatably attached at the stationarily held centring device. The centring bars are thereby shaped as streamlined in such way that they provide a low flow resistance to the water flowing past.

High forces act on the propeller, which also act on the propeller transverse to the axis of rotation due to the water flowing turbulently in the flow channel. In order to be able to safely intercept these forces and to still permit a smooth rotation of the propeller, it may be provided that a bearing, in which the shaft is mounted, is respectively arranged on the centring device and on the flow stator. Vibration and bending of the shaft are prevented by the two-sided mounting. By this means, the radial position of the propeller is securely attached. This permits the provision of only a small gap between the rotor and the stator mounted radially outside of the rotor. Due to these measures, an electric motor with a high efficiency is obtained. Collisions between the rotor and the stator or between the rotor housing and the stator housing may be safely prevented.

In order to be able to permanently and smoothly mount the shaft, it may be provided that a first bearing housing is designed within the base of the centring device, that the front bearing is held in the first bearing housing, and that the first bearing housing is closed water-tight with respect to the flow channel with a removable inflow cap. The front bearing is thus protected from moisture. In the case of necessary maintenance, the front bearing may be easily reached by removing the inflow cap.

A permanent, smooth mounting of the shaft may be achieved additionally in that an additional bearing housing is designed within the stator base of the flow stator, that the rear bearing is held in the additional bearing housing, and that the additional bearing housing is closed water-tight with a removable bearing support ring. The rear bearing is thus protected from moisture. In the case of necessary maintenance, the rear bearing may be easily reached by removing the bearing support ring.

The swimming and diving aid functions as a water sport device. For this purpose, it must be designed so that a user may not injure himself or herself on the device. To prevent a user from reaching into the running propeller, it may be provided that a contact protection with contact protection bars moulded thereon is arranged on the side of the flow stator facing away from the propeller, that the contact protection bars are directly or indirectly attached to the wall of the flow channel, and that preferably a base body of the contact protection is connected to the flow stator. The contact protection bars are thereby designed such that they influence the flow of the water as little as possible; however, prevent reaching into the flow channel. If the base body of the contact protection is connected to the flow stator, then this may be additionally supported with respect to the flow channel. This leads to an additional stabilization of the position of the rear bearing of the shaft, and thus to the radial position of the propeller.

Corresponding to a particularly preferred embodiment variant of the invention, it may be provided that an underwater drive unit is formed at least from the electric motor with the rotor housing and the stator housing, the centring device, the inflow cap, the flow stator, and the propeller with the shaft and the bearings. The underwater drive unit may be preassembled as a module and installed in the flow channel. By this means, the assembly of the swimming and diving aid is significantly simplified, which reduces production costs.

Figure 2:
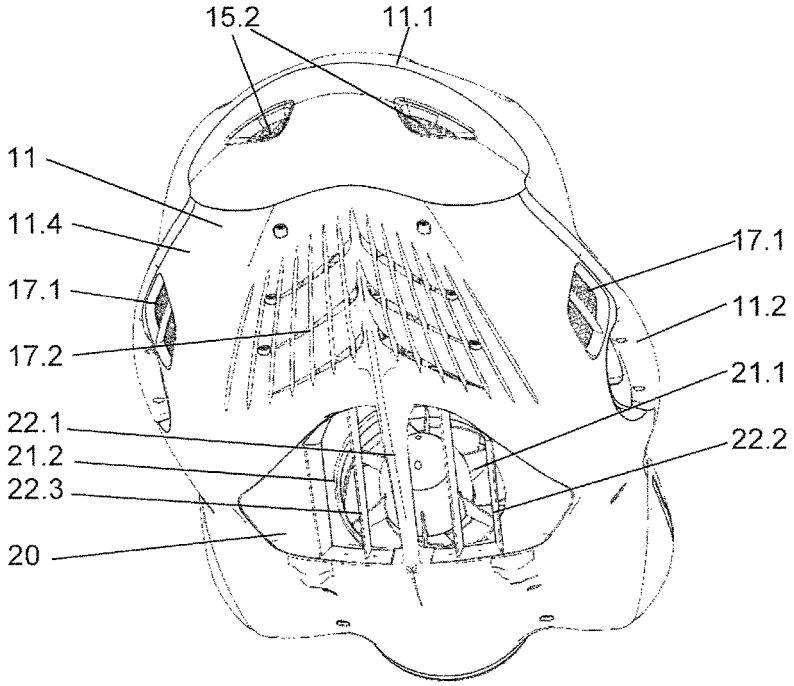

The invention will be subsequently explained in greater detail based on the embodiment depicted in the drawings. As shown in:

FIG. 1 a swimming and diving aid in a perspective side view from the rear,

FIG. 2 the swimming and diving aid shown in FIG. 1 in a perspective view from below, FIG. 3 the swimming and diving aid in a lateral cutaway view in the area of a flow channel depicted as opened, FIG. 4 the swimming and diving aid in a lateral cutaway view with an underwater drive unit likewise depicted in cross section, FIG. 5 a section of the cutaway view shown in FIG. 4 in the area of a propeller, FIG. 6 a section of the cutaway view shown in FIG. 4 in a front bearing area, and FIG. 7 a section of the cutaway view shown in FIG. 4 in a rear bearing area.

FIG. 1 shows a swimming and diving aid 10 in a perspective side view from the rear. Swimming and diving aid 10 has a vehicle hull 11. Vehicle hull 11 is combined from an upper part 11.6 and a lower part 11.4. Upper part 11.6 is equipped with two handholds 16 which are arranged on the two sides of vehicle hull 11. A user may hold on to these handholds 16 and control swimming and diving aid 10 using operating elements 16.1 attached to handholds 16. In particular, the engine output of swimming and diving aid 10 may be varied here. The user, who holds onto handholds 16, lies with his or her upper body on upper part 11.6 on a contact surface 11.3 in the area behind a display 13. A holder 11.7 is attached to contact surface 11.3 for fixing a belt system, by means of which the user may belt himself or herself onto swimming and diving aid 10. A cap 12 for a charging socket, shown lying behind this, is arranged in front of contact surface 11.3. Accumulators contained in vehicle hull 11 may be charged via the charging socket.

Carrying handles 11.2 are arranged on the sides of vehicle hull 11, by means of which swimming and diving aid 10 may be carried outside of the water.

A removable protective cover 14 is fixed on vehicle hull 11 upstream of display 13 and between the two handholds 16 in the direction of travel. Protective cover 14 overlaps an assembly section (not shown) of swimming and diving aid 10. Ventilation openings 15.1 are provided laterally in protective cover 15, which are connected to a flooding chamber 17, provided in vehicle hull 11 and shown in FIG. 3.

Water inlet openings 15.2 are provided in the area of the prow 11.1 through which water may flow into flooding chamber 17. Flooding chamber 17 may, for this purpose, be ventilated via ventilation openings 15.1 of protective cover 14. The buoyancy of swimming and diving aid 10 is adjusted by flooding chamber 17 filled with water such that predetermined buoyancy is maintained so that both floating and diving operation is possible. Water outlet openings 15.3, covered by slats, are arranged on stern 11.5 of swimming and diving aid 10, and likewise connect to flooding chamber 17. Flooding chamber 17 is flooded with water, which penetrates through water inlet openings 15.2 and water outlet openings 15.3 as soon as swimming and diving aid 10 is placed in the water. As soon as swimming and diving aid 10 transitions into travel mode, a flow is generated in flooding chamber 17. The water thereby enters into flooding chamber 17 through water inlet openings 15.2. It flows through flooding chamber 17 and thereby flushes the electric components held in flooding chamber 17, for example, accumulators necessary for driving swimming and diving aid 10. The water thereby accepts the dissipated power of the electric components and cools them. After flowing through flooding chamber 17, the water leaves the same through water outlet openings 15.3, which are arranged symmetrically on two sides of a jet discharge 26 of a flow channel 20. A contact protection 70 is arranged on an end side in flow channel 20 and prevents users from reaching into flow channel 20.

FIG. 2 shows swimming and diving aid 10 shown in FIG. 1 in a perspective view from below.

The water inlet openings, shown in FIG. 1, are visible at prow 11.1 of vehicle hull 11. Lateral flooding openings 17.1 are provided on the sides on lower part 11.4 of vehicle hull 11. Additional lower flooding openings 17.2 are introduced in the front area of lower part 11.4 and are covered by ribs moulded on vehicle hull 11. A left and a right inflow opening 21.1, 21.2 of flow channel 20 are arranged in the centre of lower part 11.4. Inflow openings 21.1, 21.2 are separated from one another by a guide element 22.1. Protective bars 22.2, 22.3 are arranged in the area of inlet openings 21.1, 21.2.

Figure 3:
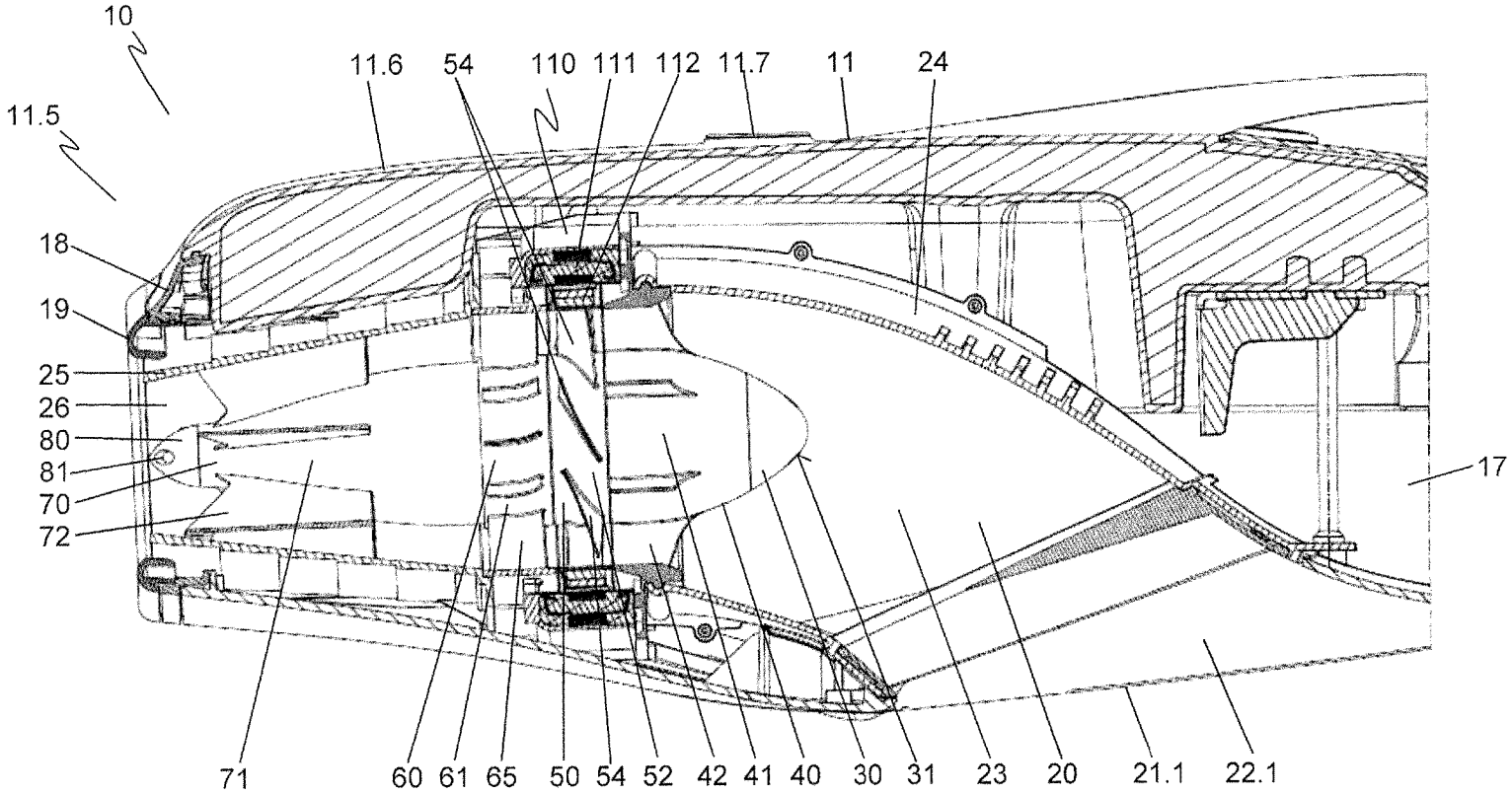

Flooding openings 17.1, 17.2 are, like water inlet openings 15.2, connected to flooding chamber 17 shown in FIG. 3. If swimming and diving aid 10 is placed in water, the water flows through flooding openings 17.1, 17.2 and water inlet openings 15.2 into flooding chamber 17 and thus adjusts the desired buoyancy of swimming and diving aid 10. If swimming and diving aid 10 is removed from the water, the water may discharge from flooding chamber 17 through flooding openings 17.1, 17.2 and water inlet openings 15.2 out of flooding chamber 17, by which means swimming and diving aid 10 loses significant weight and is thus easily carriable.

Water is sucked through inlet openings 21.1, 21.2 by a propeller 50, shown in FIG. 3 and arranged in flow channel 20, and accelerated through flow channel 20 to jet discharge 26 shown in FIG. 1. The propulsion for the swimming and diving aid is thus carried out. Guide element 22.1 and protective bars 22.2, 22.3 prevent large foreign object from being sucked in or that the user reaches into running propeller 50. In addition, guide element 22.1 and the ribs arranged in front of it have a stabilizing effect in the travel mode of swimming and diving aid 10.

FIG. 3 shows swimming and diving aid 10 in a lateral cutaway view in the area of flow channel 20 depicted as opened. The cutaway surface thereby runs to the right and parallel to a centre longitudinal plane of swimming and diving aid 10 in the direction of travel.

Flow channel 20 is guided within vehicle hull 11 in a curve from the lower side to the stern of swimming and diving aid 10. Flow channel 20 is formed in the direction of travel toward inflow openings 21.1, 21.2 by a left front flow channel half shell 23 and a right front flow channel half shell 24. Flow channel half shells 23, 24 are joined precisely to one another and connected by means of connecting elements. A front channel section is thus formed with a smooth surface. A part of flooding chamber 17, which also partially surrounds the space around flow channel 20 in the rear area of swimming and diving aid 10, is shown in front of flow channel 20 in the travel direction.

An underwater drive unit, comprising a propeller 50 with an assigned electric motor 110, a centring device 40, arranged upstream of propeller 50 in the flow direction, with an inflow cap 30 mounted on centring device 40 in a plug-in manner, a flow stator 60 arranged downstream of propeller 50 in the flow direction, and the subsequent contact protection 70 with an attached end cap 80, is arranged in flow channel 20.

Contact protection 70 is arranged in an area of a jet discharge tube 25. Jet discharge tube 25 is arranged downstream of flow stator 60 in the flow direction. It forms flow channel 20 between flow stator 60 and jet discharge 26.

A retaining ring 19 and a connection ring 18 circumferential to jet discharge 26 form the connection from the jet discharge tube 25 to vehicle hull 11.

Propeller 50 has a base part 52 on which radially outwardly projecting propeller blades 54 are moulded. Propeller blades 54 are aligned obliquely to base part 52 so that, in a right rotation of propeller 50 in the present embodiment, they suck water from inflow openings 21.1, 21.2 and discharge it from jet discharge 26.

To drive propeller 50, a rotor 112 of electric motor 110 is connected thereto. Rotor 112 is directly coupled to the outer ends of propeller blades 54 of propeller 50 for this purpose. During a rotation of propeller 50, rotor 112 moves on a circular path around propeller 50. A motor stator 111 of electric motor 110 is arranged circumferential to this circular path.

The driving force is generated between motor stator 111 and rotor 112. The transfer of the driving force to propeller 50 is carried out at the ends of propeller blades 54 by rotor 112. The force transmission is thus carried out at a large radius, wherein a high torque arises. By implication, very fast rotational speed changes of propeller 50, and thus speed changes of swimming and diving aid 10, are realized at a given output of electric motor 110.

Motor stator 111 and rotor 112 are arranged to the side of the flow channel cross section of flow channel 20, which is determined by flow channel half shells 23, 24, the outer diameter of the circular path of the propeller blades, and jet discharge tube 25. Thus, electric motor 110 does not lie in the area of the main flow of the water accelerated in flow channel 20, and thus does not negatively impact the available flow cross section, and thus the flow of the water. Flow channel 20 may thus be designed, in the case of an identical volume flow through flow channel 20, with a lower diameter in comparison to an arrangement in which a electric motor 110 acting conventionally on a drive shaft is provided in flow channel 20. By this means, the entire design of swimming and diving aid 10 may be configured more compactly.

Centring device 40 has a streamlined base 41, to which centring bars 42 are connected which are aligned radially outward, said centring bars being likewise designed in a streamline shape. Centring device 40 is attached to flow channel half shells 23, 24 using centring bars 42. Inflow cap 30 is mounted on base 41 of centring device 40 counter to the flow direction. Inflow cap 30 likewise has a streamlined inflow surface 31 which transitions gradually to the surface of base 41. The diameter of base 41 is adapted toward propeller 50 to the diameter of base part 52 of propeller 50. Due to this shape of inflow cap 30, base 41 of centring device 40, and base part 52 of propeller 50, a low flow resistance is achieved for the water flowing through flow channel 20.

Flow stator 60 has a stator base 61 on which radially outwardly directed stator blades 65 are arranged. Stator blades 65 are directly connected on an end side to flow channel 20. Flow stator 60 is thus arranged stationarily in flow channel 20.

Stator blades 65 are designed as curved along the flow direction of the water. The ends of stator blades 65 facing propeller 50 are curved at a predetermined angle counter to the direction of rotation of propeller 50. In contrast, the ends of stator blades 65 facing away from propeller 50 extend approximately parallel to the axis of rotation of propeller 50. The water leaves propeller 50 in a spiralling path. Due to the shape of stator blades 65, flow stator 60 acts counter to the rotation of the water flowing through flow channel 18, so that the water flows virtually free of rotation downstream of flow stator 60 to jet discharge 26. The rotational energy of the water is thereby converted into linear movement energy and thus functions to drive swimming and diving aid 10.

The diameter of stator base 61 preferably corresponds at least approximately to the diameter of base part 52 of propeller 50. Thus, a lower flow resistance is achieved at the transition of the water from propeller 50 to flow stator 60.

Contact protection 70 is connected to jet discharge tube 25 of flow channel 20 via radially arranged contact protection bars 72. Contact protection 70 is thus positioned stationarily in flow channel 20. Contact protection bars 72 are designed as streamlined. They are connected at their inner ends to base body 71 of contact protection 70. Base body 71 has a streamlined contour. The diameter of base body 71 toward flow stator 60 corresponds at least approximately to the diameter of stator base 61 of flow stator 60. Thus, a lower flow resistance is achieved at the transition of the water from flow stator 60 to contact protection 70. The diameter of base body 71 tapers towards jet discharge 26. The outer surface thereby preferably follows at a distance the course of the surface of jet discharge tube 25. The distance between the surfaces of base body 71 and jet discharge tube 25 delimits the flow cross section of the water flowing past. The flow cross section is selected by the shape of base body 71 and of jet discharge tube 25 such that a higher volume flow is permitted by a sufficiently large cross section; however, a high flow speed of the water toward jet discharge 26 is simultaneously imposed by a smallest possible cross section.

Base body 71 of contact protection 70 is terminated on the end side by end cap 80. A cap opening 81 is introduced into end cap 80. Water from base body 71, designed as a hollow body, may flow out through cap opening 81.

Figure 4:
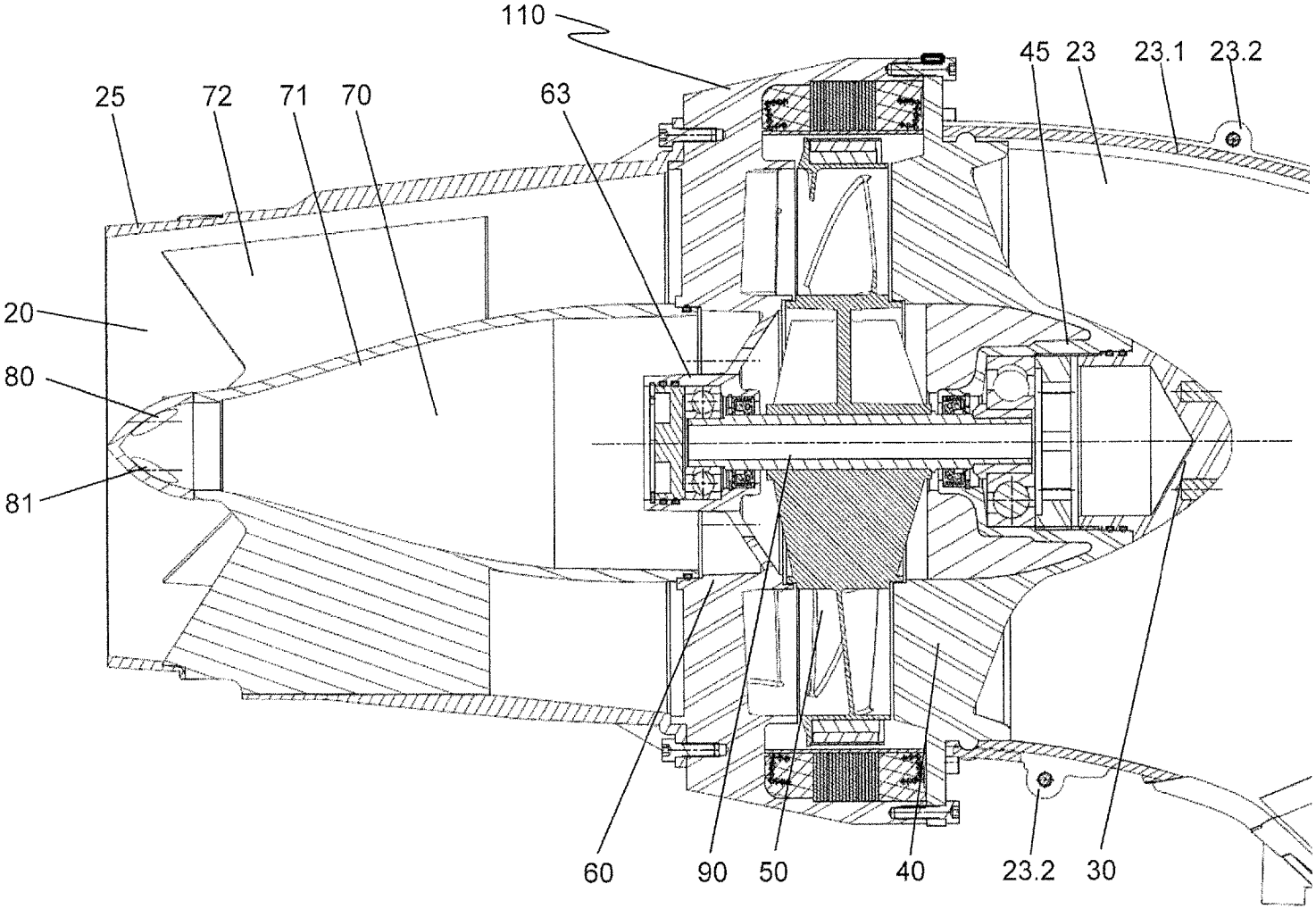

FIG. 4 shows swimming and diving aid 10 in a lateral cutaway view with an underwater drive unit likewise depicted in cross section.

In contrast to the depiction shown in FIG. 3, the cutaway surface in FIG. 4 runs along a centre longitudinal plane of the swimming and diving aid so that the components of the underwater drive unit are also shown in cutaway.

Figure 5:
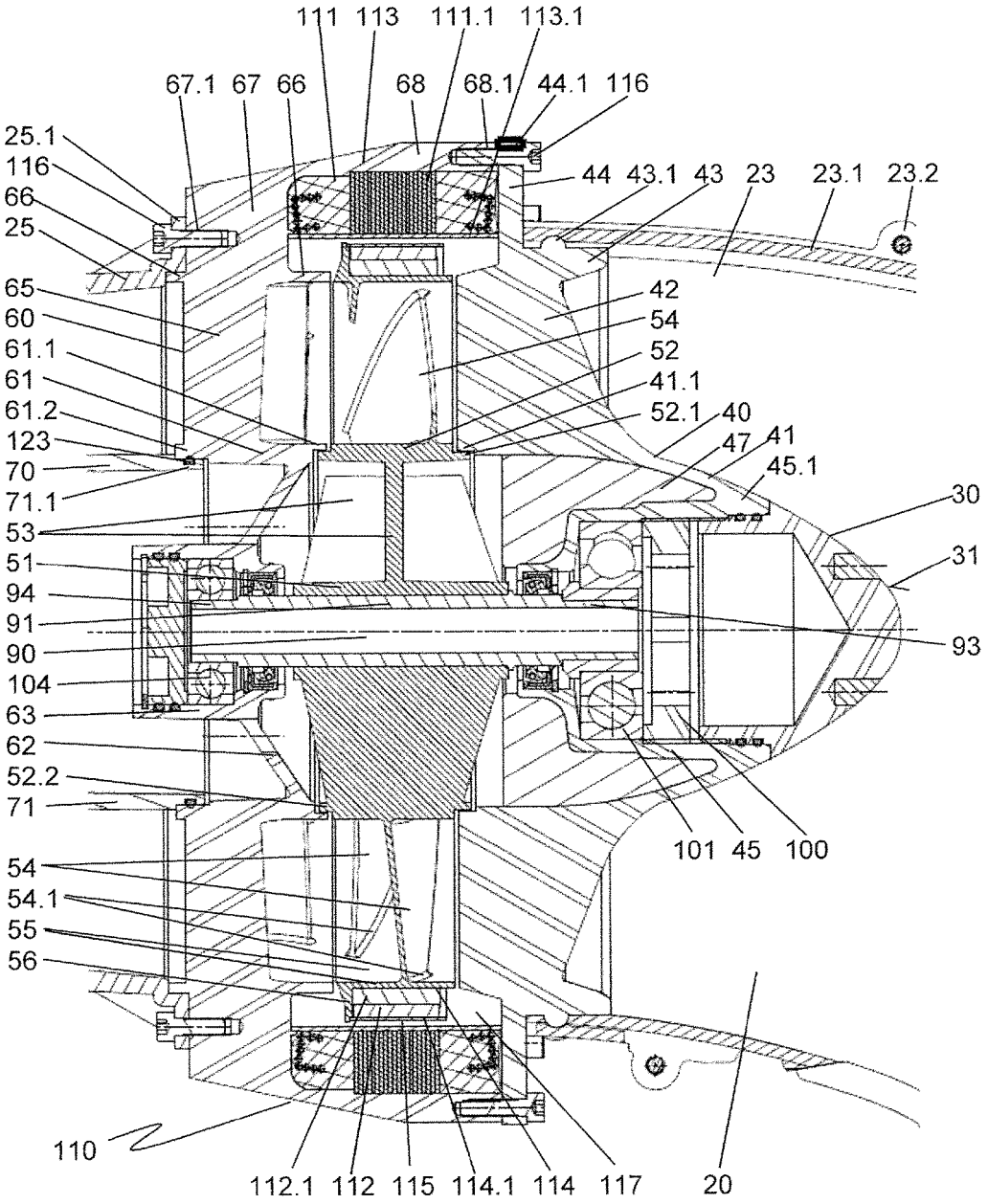

Propeller 50 is fixed to a shaft 90, as this is described in more detail in FIG. 5. A first bearing housing 45 is attached to centring device 40. Shaft 90 is rotatably mounted in first bearing housing 45. This is shown in detail in FIG. 6. A second bearing housing 63 is attached to flow stator 60. Shaft 90 is rotatably mounted in second bearing housing 63. The second bearing housing is shown enlarged in FIG. 7.

Base body 71 of contact protection 70 is designed as a hollow body. Water may flow into and out of base body 71 through cap opening 81 of end cap 80, which is likewise designed as a hollow body.

Left front flow channel half shell 23 as depicted has a left joint profile 23.1 as well as a mounting eyelets 23.2 along the centre longitudinal plane of flow channel 20. Right front flow channel half shell 24, shown in FIG. 3, is attached with its edge fixed in left guide profile 23.1 and the two flow channel half shells 24 are rigidly connected by suitable fixing means, preferably with screws guided through mounting eyelets 23.2. A sealing material may be inserted in left joint profile 23.1.

FIG. 5 shows a section of the cutaway depiction, shown in FIG. 4, in the area of propeller 50.

Shaft 90 is implemented as a hollow shaft. Shaft 90 is advantageously manufactured from a carbon fibre reinforced plastic (CFRP). The shaft is divided into a centre area 91, a front shaft bearing section 93 aligned counter to the flow direction of the water, and a rear shaft bearing section 94 diametrically opposite to the front shaft bearing section 93.

Shaft 90 is mounted in front shaft bearing section 93 using a front bearing 101. Front bearing 101 is designed as an angular ball bearing. Front bearing 101 is held by a lock nut 100 inside of first bearing housing 45 of centring device 40, as is described in greater detail in reference to FIG. 6.

Shaft 90 is mounted in rear shaft bearing section 94 using a rear bearing 104. Rear bearing 104 is designed as a grooved ball bearing.

The propeller is attached to shaft 90 using an inner cylinder 51 in centre area 91 of shaft 90. Inner cylinder 51 is preferably glued to shaft 90. Propeller struts 53 are moulded on inner cylinder 51. Propeller struts 53 are aligned in part transverse to and in part parallel to the centre longitudinal axis of shaft 90. Propeller struts 53 are connected at their outer ends to base part 52 of propeller 50. The propeller struts are preferably moulded as one piece on base part 52. Propeller struts 53 thus form a rigid connection between inner cylinder 51 and base part 52 of propeller 50. A hub area is designed as a cavity between inner cylinder 51 and base part 52. The hub area is divided by propeller struts 53, aligned transverse to the centre longitudinal axis of shaft 90, into a front chamber facing centring device 40 and a rear chamber facing flow stator 60. Passages (not shown) are introduced into these transverse running propeller struts 53. When propeller 50 is rotating, water is conveyed through the passages from the front chamber to the rear chamber.

A front connection inner shoulder 52.1 is formed on base part 52 on its edge facing centring device 40, and a rear connection inner shoulder 52.2 is formed on the diametrically opposite edge. Propeller blades 54 are fixed on the outer circumference of base part 52. Propeller blades 54 are preferably moulded as one piece on base part 52. Propeller blades 54 are connected at their outer ends via a connecting area 54.1 to a propeller ring 55 at a circumferential distance to base part 52. Propeller ring 55 is thus arranged rotationally symmetrically around the axis of rotation of shaft 90. A rotor housing front wall 56 is moulded directed radially outward on propeller ring 55. Inner cylinder 51, propeller struts 53, base part 52, propeller blades 54, propeller ring 55, and rotor housing front wall 56 are preferably manufactured as one piece.

Stator base 61 of flow stator 60 is connected to second bearing housing 63 via a connecting element 62. In the embodiment shown, connecting element 62 is designed as funnel-shaped. Connecting element 62 has through openings (not shown) through which water may escape out of the rear chamber of the hub area into the inner chamber of base part 71 of contact protection 70. A front connection outer shoulder 61.1 is formed on stator base 61 aligned toward propeller 50. Front connection outer shoulder 61.1 overlaps at a slight distance the rear connection inner shoulder of base part 52 of propeller 50. For this purpose, stator base 61 has at least approximately the same outer diameter as base part 52 of propeller 50. A rear connection outer shoulder 61.2 is moulded on stator base 61 diametrically opposite to front connection outer shoulder 61.1. Stator blades 65 are fixed to stator base 61. Stator blades 65 are thereby preferably moulded as one piece to stator base 61. Stator blades 65 are aligned radially to stator base 61, as this is already depicted in FIG. 3. Stator blades 65 are connected at their outer ends to a stator outer ring 66. Stator outer ring 66 is arranged circumferential to the axis of rotation of propeller 50. Stator outer ring 66 terminates with an edge facing propeller 50 at a short distance in front of the edge of propeller ring 55. A rear housing wall 67 is moulded on the outer surface of stator outer ring 66. The cutaway in the depiction shown runs through a reinforced area of housing wall 67 in which a thread bore 67.1 is introduced for accommodating a screw 116. Such reinforced areas with thread bores 67.1 are provided spaced apart along housing wall 67. Housing wall 67 is designed as thin-walled in between. A housing cover 68, which overlaps propeller ring 55 at a radial distance, is moulded on housing wall 67. Threaded receptacles 68.1 for receiving screws 116 are introduced into the front face of housing cover 68.

Second bearing housing 63, connecting element 62, stator base 61, stator blades 65, stator outer ring 66, rear housing wall 67, and housing cover 68 are preferably designed as one piece.

Jet discharge tube 25 is fixed on housing wall 67 by means of screws 116. A radially aligned flange 25.1 is moulded on jet discharge tube 25 for this purpose, in which bore holes for conducting screws 116 are introduced exactly at thread bores 67.1 of housing wall 67.

Base body 71 of contact protection 70 has a step-shaped stator connection area 71.1 incorporated on its end facing flow stator 60. Stator connection area 71.1 is inserted into rear connection outer shoulder 61.2 of stator base 61 so that a circumferential plug connection is created. A fourth sealing ring 123 is provided between stator connection area 71.1 and rear connection outer shoulder 61.2. Fourth sealing ring 123 seals the interior of base body 71 from flow channel 20.

Centring device 40 is arranged upstream of propeller 50 in the flow direction. Rotationally symmetrical base 41 of centring device 40 has the same outer diameter at its transition area to base part 52 of propeller 50 as base part 52. This leads to a low flow resistance for the water flowing past. The outer diameter of base 41 tapers along a concave curve toward inflow cap 30. Base 41 has a connection shoulder 41.1 toward propeller 50. Connection shoulder 41.1 overlaps at a slight radial distance the rear connection inner shoulder 52.2 of base part 52 of propeller 50. Centring bars 42 are attached radially aligned to base 41. Centring bars 42 are thereby preferably moulded on base 41 as one piece. Centring bars 42 are designed as slender in the extension running tangential to base 41. They thus oppose the water flowing past with a low flow resistance. Centring bars 42 overlap over half of the length of base 41 in their axial alignment. Their front edge opposing the inflowing water slopes down at increasing radial distance toward the base in the flow direction of the water. This measure also reduces the flow resistance of the water flowing past. A centring outer ring 43 is fixed on the outer ends of centring bars 42. Centring outer ring 43 is preferably connected to centring bars 42 as one piece. A radially outwardly aligned front housing wall 44 is fixed on centring outer ring 43, in particular moulded as one piece. Front housing wall 44 extends in its outer diameter up to housing cover 68 and contacts the front face of said housing cover. Assembly bore holes 44.1 are provided in housing wall 44. Assembly bore holes 44.1 are arranged congruent to threaded receptacles 68.1 of housing cover 68. Housing wall 44 and housing cover 68 are rigidly connected using screws 116 guided through assembly bore holes 44.1 and screwed into threaded receptacles 68.1.

A detent lug 43.1 is moulded on the outer surface of centring outer ring 43. Detent lug 43.1 is designed as a circumferential bead moulded on centring outer ring 43 in the present embodiment. However, hemispherical detent lugs 43.1 might also be provided spaced apart around centring outer ring 43. Centring device 40 with its centring outer ring 43 is inserted into flow channel 20 formed by flow channel half shells 23, 24. Centring outer ring 43 is thereby inserted into flow channel 20 until flow channel half shells 23, 24 contact front housing wall 44 on an end side or are arranged directly in front of the same. In this position, the detent lug 43.1 snaps into a circumferential detent receptacle incorporated into flow channel half shells 23, 24. Centring device 40 is thus rigidly anchored in flow channel 20.

First bearing housing 45, directed inward, is moulded on base 41 of centring device 40. First bearing housing 45 is attached via a first sealing area 45.1 to the end of base 41 directed opposite to the flow of the water. First bearing housing 45 has a pot-shaped contour, wherein the connection to base 41 is carried out on the pot rim. First bearing housing 45 is arranged in the cavity formed by base 41 aligned in the flow direction of the water. The intermediate space between first bearing housing 45 and base 41 is filled by a sealing compound 47. Thus, no water may collect in this area. Inflow cap 30 is mounted on base 41 in first sealing area 45.1.

A motor housing 117 of electric motor 110 is formed by housing cover 68, rear housing wall 67 and front housing wall 44. Motor housing 117 is delimited toward flow channel 20 by stator outer ring 66, propeller ring 55, and centring outer ring 43. Motor housing 117 is thus arranged radially outside of the flow cross section, predetermined by the diameter of flow channel 20, of the water flowing in flow channel 20. The radially outward area of motor housing 117 is separated by a stator housing cover 113.1. The separated area forms a stator housing 113. The motor stator 111 of electric motor 110 is arranged in stator housing 113. Motor stator 111 is formed from a predetermined number of electromagnets. These are arranged at predetermined regular or irregular intervals 113 along annular stator housing 113. At least one coil 111.1 is assigned to each electromagnet. The cavities of stator housing 113 are preferably sealed with a sealing compound. Motor stator 111 is thus embedded in the sealing compound.

A rotor housing 114 is formed inside of motor housing 117 by propeller ring 55, rotor housing front wall 56, and a rotor housing cover 114.1. Rotor housing cover 114.1 is arranged radially outward spaced apart from propeller ring 55. On one side, rotor housing cover 114.1 contacts rotor housing front wall 56. Rotor 112 of electric motor 110 is mounted within rotor housing 114. Rotor 114 is formed by a predetermined number of permanent magnets 112.1. These are arranged at predetermined regular or irregular intervals 113 along annular rotor housing 114. Rotor 114 and/or permanent magnets 112.1 are embedded in a sealing compound introduced into rotor housing 114. Thus, rotor 114 and/or permanent magnets 112.1 are connected to rotor housing 114. Rotor housing cover 114.1 is likewise fixed with the sealing compound. An air gap 115 is formed between stator housing cover 113.1 and rotor housing cover 114.1.

Electric motor 110 corresponds in design to a ring motor or a torque motor. Electric motor 110 is thereby designed as an internal rotor. Since rotor 112 is arranged at a large radial distance from the axis of rotation of electric motor 110, a high torque may be achieved by this design and is transferred to propeller 50. Furthermore, the torque may be increased by a high number of pole pairs with corresponding numbers of electromagnets and permanent magnets 112.1. Thus, fast changes in the rotational speed of propeller 50, and thus fast and dynamic changes in the speed of swimming and diving aid 10, may be achieved.

Motor housing 117 lies preferably outside of the flow cross section of the water determined by flow channel 20 and the diameter of propeller blades 54. Thus, the available flow cross section is not reduced by electric motor 110 with the already described advantages.

Motor housing 117 is not sealed with respect to flow channel 20. A gap is formed between propeller ring 55 and stator outer ring 66 or centring outer ring 43 respectively, through which water may flow into motor housing 117. Motor stator 111 and rotor 112 are sealed inside of stator housing 113 or rotor housing 114 with respect to the inflowing water. The waste heat from electric motor 110 is efficiently removed by the water flowing past. This leads to a high efficiency of electric motor 110. Motor stator 111 and/or rotor 112 are, in particular, protected from water penetration by the respectively provided sealing compound. The sealing compound likewise forms a thermal bridge with good heat conductive properties so that the waste heat from electric motor 110 may be efficiently discharged to the surrounding water.

Shaft 90 is advantageously mounted on two sides of propeller 50. Thus, high lateral forces, transferred to propeller 50 by the water flowing past, may be safely absorbed. A bending of shaft 90 or vibrations of shaft 90 and propeller 50 may be prevented. Thus, the air gap 115 formed between motor stator 111 and rotor 112 may be constantly maintained. This leads to very quiet running. Furthermore, the driving force is not influenced by fluctuating widths of air gap 115. A collision of rotor housing 114 with stator housing 113 is safely prevented.

Due to shaft 90 being designed as a hollow shaft, weight may be saved without substantially influencing the stiffness of shaft 90. A lower weight is an essential advantage for a carriable water sport device like the present swimming and diving aid. The weight is further reduced in that the shaft comprises a carbon fibre reinforced plastic (CFRP).

CFRP offers the advantage of a significantly reduced weight at a simultaneously high rigidity over conventional materials, for example steel, which are used to produce shafts 90. In comparison to steel, a shaft 90 produced from CFRP has significantly less tendency toward vibrations, which leads to an improved concentric running and lower noise. In addition, the lower weight and the reduced vibration lead to a reduction of the load on bearings 101, 104, by means of which shaft 90 is mounted to be rotatable about its centre longitudinal axis, by which means the wear on bearings 101, 104 is reduced and thus their service life is increased. The inertial mass of shaft 90 made from CFRP is reduced significantly over a shaft 90 made from steel, by which means a higher dynamic arises at desired changes of the rotational speed of shaft 90 and thus propeller 50. At the same time, the energy consumption for accelerating shaft 90 with propeller 50 decreases, which leads to an extension of the operating time of accumulator-powered swimming and diving aid 10.

To increase the rigidity of shaft 90, it may be designed as multi-layered. An inner layer, in which carbon fibre mats are arranged with different orientations of the carbon fibers within the plastic matrix, is followed by a layer with aligned carbon fibres. These are preferably designed as high modulus carbon fibres which have a very high modulus of elasticity in the fibre direction, for example, >400,000 $N/mm^2$. In the present embodiment, the high modulus carbon fibres are essentially aligned in the direction of the longitudinal extension of shaft 90 in order to thus increase the rigidity and the flexural strength of shaft 90. Alternatively or additionally, a CFRP layer with high modulus carbon fibres arranged transverse to the longitudinal extension of shaft 90 may also be provided. In this arrangement, the additional carbon fibres increase the torsional strength of shaft 90.

The surface of shaft 90 is stripped, ground, or polished in sections. Due to these post-production steps, an exact, rotationally symmetrical contour of shaft 90 is obtained, which leads to good concentric running. Cracks in the surface are removed and thus notch stresses, which form mechanical loads at the crack ends, are prevented or at least reduced. The probability of failure of shaft 90 thereby decreases and its endurance increases. To prevent the carbon fibres from being damaged in the post-treatment, the shaft has an outer finishing plastic layer, which contains no carbon fibers.

A rigid and heavy duty connection is achieved between inner cylinder 51 and base part 52 of propeller 50 due to propeller struts 53 aligned partially transverse and partially parallel to the centre longitudinal axis of shaft 90.

Inner cylinder 51, propeller struts 53, base part 52, propeller blades 54, propeller ring 55, and rotor housing front wall 56 preferably represent a one piece component. This may be manufactured, for example, from plastic material. Propeller 50 with the associated components may thus be produced inexpensively in one production step.

Alternatively, propeller 50, with the associated components—inner cylinder 51, propeller struts 53, base part 52, propeller blades 54, propeller ring 55 and rotor housing front wall 56—may be manufactured completely or partially from metal.

Centring device 40 and flow stator 60 are rigidly connected to flow channel 20. The positions of front and second bearing housings 45, 63, and thus the position of bearings 101, 104 of shaft 90 are thus rigidly predetermined and fixed. A correct positioning of propeller 50 within flow channel 20 is thus ensured. Due to the rigid connection between centring device 40, propeller 50, and flow stator 60, as well as the motor housing 117, formed therein and comprising stator housing 113 and rotor housing 114, the movable parts of the underwater drive unit are rigidly aligned opposite to one another. Influencing vibrations and shocks, which occur often in regular operation of swimming and diving aid 10, may thus be compensated for. In particular, small spacings I between movable and fixed components may be provided. In particular, air gap 115 between rotor 112 and motor stator 111 may be designed as narrow, which leads to a high force transmission and to a high efficiency of electric motor 110.

Figure 6:
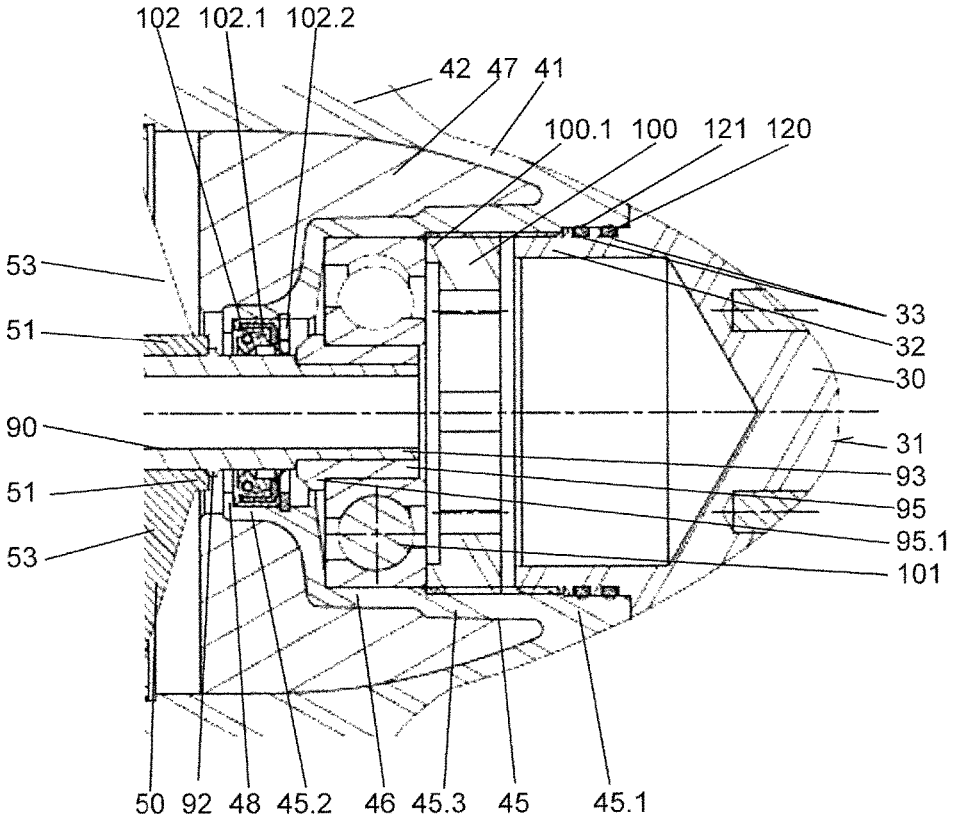

FIG. 6 shows a section of the cutaway view shown in FIG. 4 in a front bearing area.

The front bearing area is surrounded by first bearing housing 45. First bearing housing 45 is moulded as one piece on base 41 of centring device 40. Starting from first sealing area 45.1 aligned toward inflow cap 30, a cylindrical guiding section 45.3 follows into the inner space of base 41. A front bearing support 46, with a slightly reduced diameter with respect to cylindrical section 45.3, connects to cylindrical section 45.3. A second sealing area 45.2 is formed by a subsequent additional reduction of the diameter of first bearing housing 45. A radially inwardly directed first abutment 48 is moulded on second sealing area 45.2.

Shaft 90 with its front shaft bearing section 93 is inserted into first bearing housing 45 from the side of second sealing area 45.2. A propeller stop 92, which inner cylinder 51 of propeller 50 contacts, is moulded circumferential to shaft 90. The diameter of front shaft bearing section 93 of shaft 90 is reduced on the end side. A bearing seat 95 is fixed on this section of reduced diameter. Bearing seat 95 is manufactured from metal and is connected to shaft 90 in particular by gluing. Bearing seat 95 has a bearing stop 95.1 protruding radially outward toward shaft 90.

A front bearing 101 is pushed onto bearing seat 95. Front bearing 101 is designed as an angular ball bearing. It contacts with its inner race on bearing stop 95.1 of bearing seat 95. The outer race of front bearing 101 with its outer surface contacts front bearing support 46 of first bearing housing 45. The outer race of front bearing 101 is held by lock nut 100 which is attached inside in the cylindrical section of first bearing housing 45. For this purpose the outer race contacts a first outer race counter bearing 101.1 moulded on lock nut 100.

A front radial sealing area 102 is formed in second sealing area 45.2 of first bearing housing 45. For this purpose, a front radial shaft sealing ring 102.1 is arranged between second sealing area 45.2 and front shaft bearing section 93 of shaft 90. Front radial shaft sealing ring 102.1 is held toward propeller 50 by inwardly directed first abutment 48 of bearing housing 45. Front radial shaft sealing ring 102.1 is held diametrically opposite by a first securing ring 102.2. First securing ring 102.2 is clamped into a groove in first bearing housing 45.

Inflow cap 30 has a connecting piece 32 directed toward bearing housing 45. Sealing ring accommodations 33 are incorporated in connecting piece 32. Sealing rings 120, 121 are inserted into sealing ring accommodations 33. Inflow cap 30 with connecting piece 32 is inserted into first sealing area 45.1 of centring device 40. Sealing rings 120, 121 thereby prevent water from flow channel 20 from penetrating into the inner space of inflow cap 30 and first bearing housing 45.

Shaft 90 is mounted to be easily rotatable on its front bearing mounting section 93 via front bearing 101. Front bearing 101 is securely held by bearing seat 95 with bearing stop 95.1, lock nut 100 with first outer race counter bearing 100.1 and front bearing support 46. Lock nut 100 thereby allows the play to be set at which front bearing 101 is axially held. The area of front bearing 101 is sealed toward shaft 90 by the front radial shaft sealing ring. On the side of inflow cap 30, the sealing between first sealing area 45.1 of centring device 40 and connecting piece 32 of inflow cap 30 is carried out by sealing rings 120, 121 arranged there. Front bearing 101 is thus protected from penetration by moisture. In addition, the cavities in shaft 90 and front bearing 101 are filled with grease and thus additionally protected from moisture.

The reaction force of the water is transferred via propeller 50 to shaft 90 by inner cylinder 51 of propeller 50. Shaft 90 transfers this force to the inner ring of front bearing 101 via bearing seat 95. The force is transferred to the outer race of front bearing 101 via the ball bearings inside of front bearing 101, which is designed as an angular ball bearing. From there, the force input to centring device 40 is carried out via lock nut 100, and from there to flow channel 20 and vehicle 11 of swimming and diving aid 10.

Bearing seat 95, manufactured from metal, prevents the surface of shaft 90, manufactured from CFRP, from being damaged by the high forces that are transferred.

Figure 7:
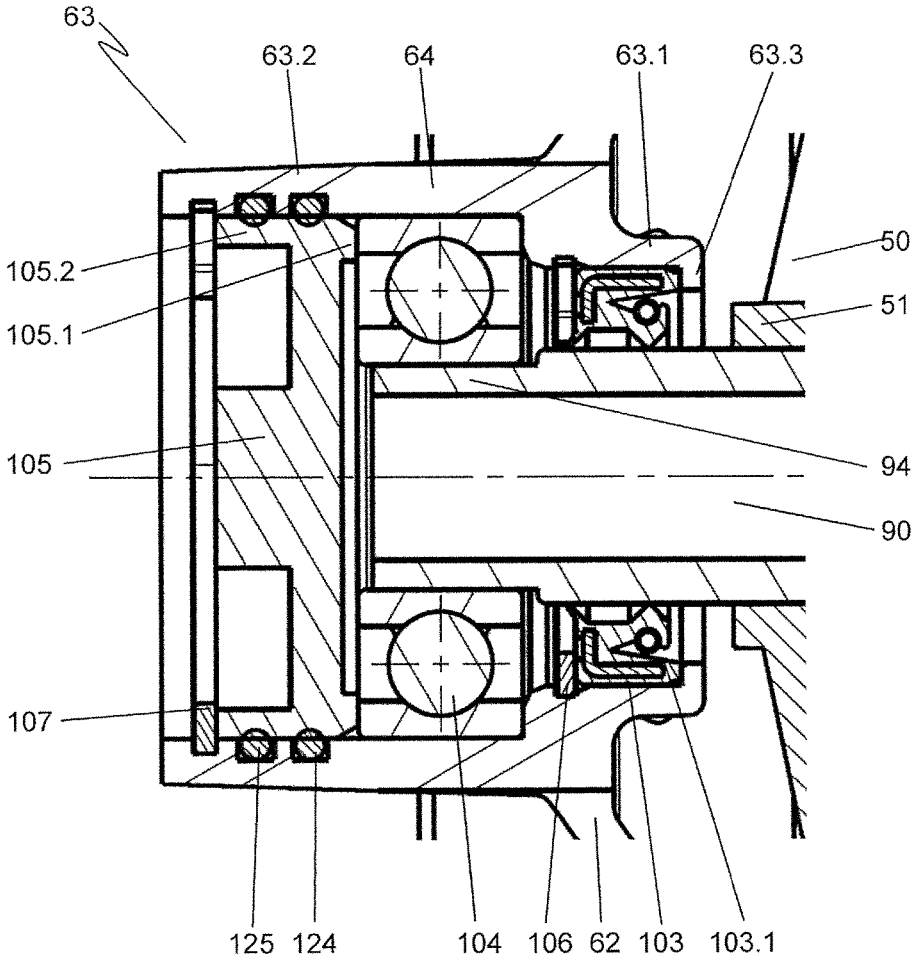

FIG. 7 shows a section of the cutaway view shown in FIG. 4 in a rear bearing area.

Second bearing housing 63 is moulded on connecting element 62 of flow stator 60. Starting from the end facing stern 11.5 of swimming and diving aid 10, second bearing housing 63 is formed by a fourth sealing area 63.2, a rear bearing support 64, a third sealing area 63.2, and a second abutment 63.3.

Fourth sealing area 63.2 and rear bearing support 64 form an area of second bearing housing 63 radially circumferential to the axis of rotation of shaft 90. Third sealing area 63.1 is reduced in diameter for this purpose. Second abutment 63.3 aligned radially inward is moulded on the end of third sealing area 63.1.

Shaft 90 is inserted with its rear shaft bearing section 94 through third sealing area 63.1 into second bearing housing 63. A rear radial shaft sealing ring 103.1 is arranged between third sealing area 63.1 and shaft 90. Rear radial shaft sealing ring 103.1 is held in its axial position toward propeller 50 by radially projecting second abutment 63.3 of bearing housing 63 and diametrically opposite by a second securing ring 106. A rear radial sealing area 103 is formed by radial shaft sealing ring 103.1, shaft 90, and third sealing area 63.1.

Rear bearing 104 is arranged between rear shaft bearing section 94 and rear bearing support 64 of second bearing housing 63. Rear bearing 104 thereby contacts with its inner race rear shaft bearing section 94, and with its outer race rear bearing support 64. Rear bearing 104 is designed as a single-row grooved ball bearing. Rear bearing 104 is held axially toward stern 11.5 of swimming and diving aid 10 by a rear bearing support ring 105. A second outer race counter bearing 105.1 aligned toward rear bearing 104 is moulded on rear bearing support ring 105 for this purpose. The outer race of rear bearing 104 contacts this outer race counter bearing 105.1.

The outer circumference of rear bearing support ring 105 is formed by an annular positioning section 105.2 which contacts the inner surface of fourth sealing area 63.2 of second bearing housing 63. Two sealing rings 124, 125 are arranged between annular positioning section 105.2 and fourth sealing area 63.2. Sealing rings 124, 125 are inserted into grooves, which are incorporated into fourth sealing area 63.2. Rear bearing support ring 105 is inserted into fourth sealing area 63.2. A third securing ring 107 is provided in connection to rear bearing support ring 105. Rear bearing support ring 105 is thus held in its position.

Water is prevented from penetrating along shaft 90 into second bearing housing 63 by rear radial shaft sealing ring 103.1. Second bearing housing 63 is likewise sealed by rear bearing support ring 105 and circumferential sealing rings 124, 125. Rear bearing 104 is thus protected from moisture. In addition, the cavities in the shaft and in the area of rear bearing 104 are filled with grease and thus additionally protected from moisture.

For assembly, shaft 90 is inserted into second bearing housing 63, rear radial shaft sealing ring 103.1 is mounted and secured using second securing ring 106. Finally, rear bearing 104 is mounted and the rear bearing support ring is inserted. Initially, third securing ring 107 is clamped in the groove provided. The bearing area is thus easier to assemble. Rear bearing 104 and rear radial shaft sealing ring 103.1 may be easily reached for maintenance purposes due to inserted rear bearing support ring 105.

The invention claimed is:

1. A swimming and diving aid, comprising:

a vehicle hull on which a user may lie or stand;

a flow channel arranged in the vehicle hull;

a propeller arranged within the flow channel, the propeller configured to create a flow direction of water flowing through the flow channel, the propeller including a base part and a plurality of radially outward extending propeller blades coupled to the base part;

an electric motor configured to drive the propeller, the electric motor including a motor stator and a rotatable rotor, the rotor being coupled directly or indirectly to an outer end of at least one of the propeller blades, and the motor stator being fixed relative to the flow channel and arranged circumferentially around the rotor;

a flow stator including a plurality of radially outward extending stator blades, the flow stator being arranged downstream of the propeller in the flow direction of the water passing through the flow channel, wherein the flow stator is coupled directly or indirectly to a wall of the flow channel via an outer end of at least one stator blade of the plurality of stator blades;

a contact protection including a base body and a plurality of contact protection bars integrally formed on the base body, the contact protection being arranged on a side of the flow stator facing away from the propeller;

wherein the plurality of contact protection bars are coupled to a wall of the flow channel; and wherein the base body of the contact protection is coupled to the flow stator.

2. The swimming and diving aid of claim 1, further comprising a propeller ring coupled to the outer end of the at least one propeller blade, wherein the rotor is arranged on the propeller ring.

3. The swimming and diving aid of claim 2, wherein the propeller ring is integrally formed with the propeller.

4. The swimming and diving aid of claim 1, further comprising an annular rotor housing coupled to the outer end of the at least one propeller blade, wherein the rotor is arranged in the rotor housing.

5. The swimming and diving aid of claim 4, wherein the rotor housing is integrally formed with the propeller.

6. The swimming and diving aid of claim 1, wherein the rotor includes a plurality of permanent magnets arranged circumferentially around the rotor.

7. The swimming and diving aid of claim 1, wherein the motor stator includes a plurality of electromagnets arranged circumferentially around the rotor.

8. The swimming and diving aid of claim 1, further comprising a stator housing for accommodating the motor stator, the stator housing coupled to the outer end of the at least one stator blade of the plurality of stator blades.

9. The swimming and diving aid of claim 8, wherein the stator housing is integrally formed with the flow stator.

10. The swimming and diving aid of claim 1, further comprising a lateral recess formed in a side of the flow channel, the motor stator being received in the lateral recess.

11. The swimming and diving aid of claim 1, further comprising a rotatably mounted shaft arranged within the flow channel, wherein the propeller is axially fixed on the rotatably mounted shaft.

12. A swimming and diving aid, comprising:

a vehicle hull on which a user may lie or stand;

a flow channel arranged in the vehicle hull;

a propeller arranged within the flow channel, the propeller configured to create a flow direction of water flowing through the flow channel, the propeller including a base part and a plurality of radially outward extending propeller blades coupled to the base part;

an electric motor configured to drive the propeller, the electric motor including a motor stator and a rotatable rotor, the rotor being coupled directly or indirectly to an outer end of at least one of the propeller blades, and the motor stator being fixed relative to the flow channel and arranged circumferentially around the rotor;

a rotatably mounted shaft arranged within the flow channel;

wherein the propeller is axially fixed on the rotatably mounted shaft: and wherein the shaft is a hollow shaft manufactured from a carbon fiber reinforced plastic material.

13. The swimming and diving aid of claim 1, further comprising a centering device including a base and a plurality of centering bars, the centering device arranged upstream of the propeller in the flow direction of the water flowing in the flow channel, wherein the centering device is coupled directly or indirectly to a wall of the flow channel via the plurality of centering bars.

14. The swimming and diving aid of claim 13, further comprising:

a rotatably mounted shaft arranged within the flow channel, wherein the propeller is axially fixed on the rotatably mounted shaft; and a front bearing coupled to the centering device and a back bearing coupled to the flow stator, wherein the shaft is received in the front bearing and the rear bearing.

15. The swimming and diving aid of claim 14, further comprising a first bearing housing disposed within the base of the centering device, wherein the first bearing housing is coupled to the front bearing, wherein the first bearing housing is water-tight with respect to the flow channel and includes a removable inflow cap.

16. The swimming and diving aid of claim 15, further comprising a second bearing housing disposed within the stator base of the flow stator, wherein the second bearing housing is coupled to the rear bearing, wherein the second bearing housing is water-tight and includes a removable bearing support ring.

17. The swimming and diving aid of claim 16, wherein at least the electric motor, the centering device, the flow stator, the propeller, the shaft and the bearings form an underwater drive unit.

* * * * *